US011724262B2

(12) United States Patent
Beebe et al.

(10) Patent No.: US 11,724,262 B2
(45) Date of Patent: Aug. 15, 2023

(54) METHOD OF FACILITATING THE HANDLING OF A VOLUME OF FLUID

(71) Applicant: Wisconsin Alumni Research Foundation, Madison, WI (US)

(72) Inventors: David J. Beebe, Monona, WI (US); Jay W. Warrick, Madison, WI (US); David J. Guckenberger, Jr., Oconomowoc, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 362 days.

(21) Appl. No.: 17/032,671

(22) Filed: Sep. 25, 2020

(65) Prior Publication Data

US 2021/0016285 A1 Jan. 21, 2021

Related U.S. Application Data

(62) Division of application No. 15/277,029, filed on Sep. 27, 2016, now Pat. No. 10,807,094.

(51) Int. Cl.
*B01L 3/00* (2006.01)

(52) U.S. Cl.
CPC ..... *B01L 3/52* (2013.01); *B01L 3/561* (2013.01); *B01L 3/563* (2013.01); *B01L 2300/043* (2013.01); *B01L 2300/0832* (2013.01); *B01L 2400/0409* (2013.01)

(58) Field of Classification Search
CPC .. B01L 3/52; B01L 3/561; B01L 3/563; B01L 2300/043; B01L 2300/0832; B01L 2400/0409
See application file for complete search history.

(56) References Cited

U.S. PATENT DOCUMENTS

2012/0277697 A1 11/2012 Haghgooie et al.
2014/0309096 A1 10/2014 Wilkinson et al.

OTHER PUBLICATIONS

"Rapid DNA Isolation From Mammalian Cell Lysates Using the Gilson Extractman(TM)", Gilson, Inc., Middleton, WI 53562, downloaded from www.gilson.com/Resources/TRANS0615_EXTRACTMAN_DNA.pdf on Dec. 30, 2016.

*Primary Examiner* — Shuyi S. Liu
(74) *Attorney, Agent, or Firm* — Boyle Fredrickson, S.C.

(57) ABSTRACT

A device and method are provided to facilitate the handling of a volume of fluid. The device includes an elongated tube having an open first end and a second end. The tube defines a reservoir for receiving the volume of fluid. A stanchion has a first end received within the reservoir of the tube and a second end projecting from the open end of the elongated tube. In operation, the elongated tube is deposited in a first capsule having fluid therein. The first capsule is centrifuged such that the volume of fluid is received in a reservoir in the tube through the open end. The tube is removed from the first capsule and positioned in a second capsule such that the open end of the tube is spaced from a closed end of the second capsule. The second capsule is centrifuged such that the volume of fluid is expelled from the reservoir of the tube.

17 Claims, 4 Drawing Sheets

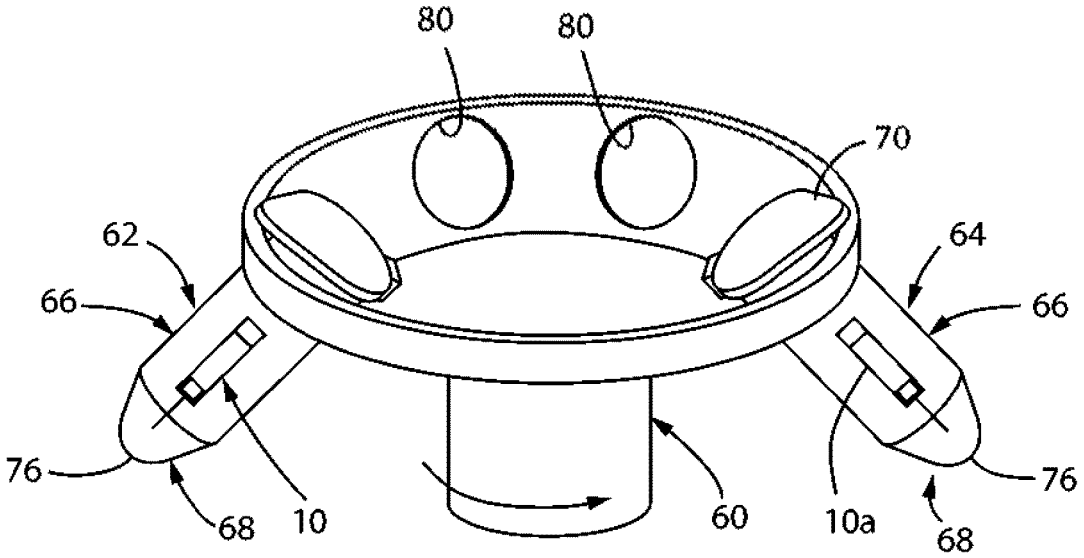
Fig. 4
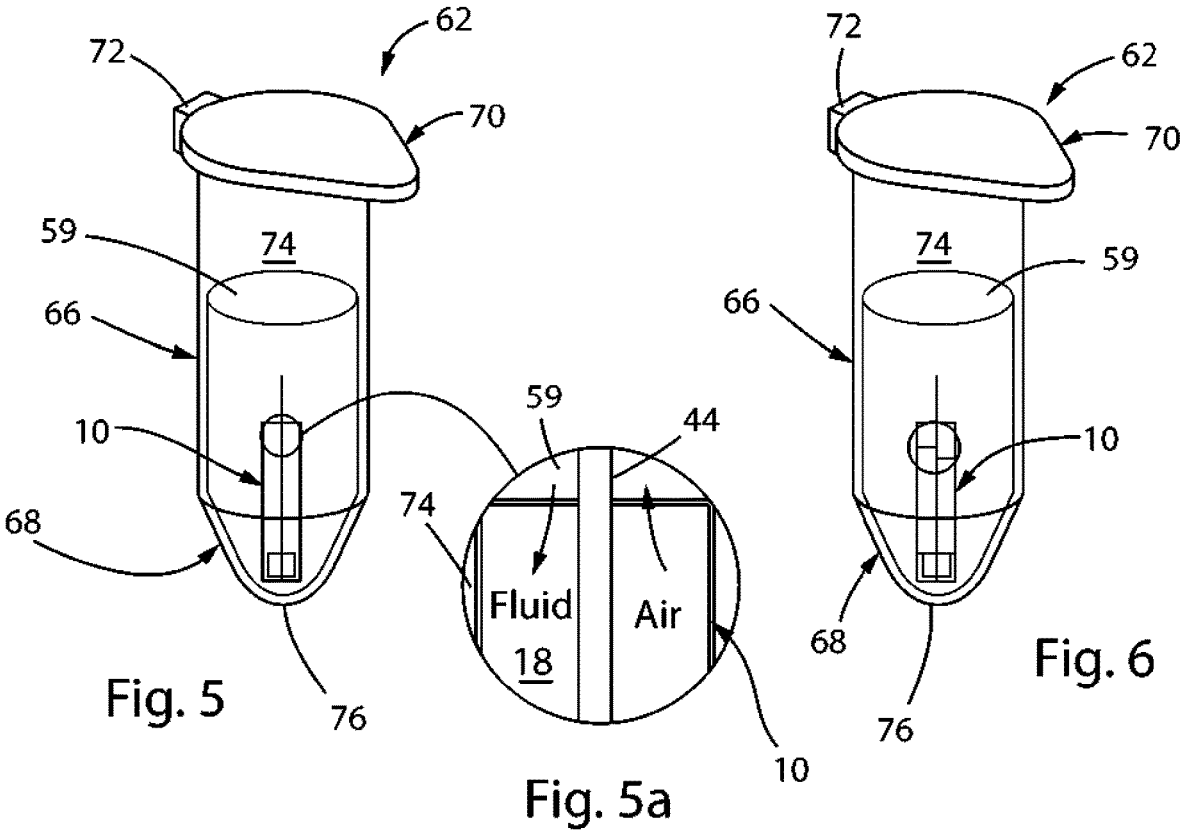

METHOD OF FACILITATING THE HANDLING OF A VOLUME OF FLUID

CROSS REFERENCE TO RELATED APPLICATION

This application is a divisional of U.S. application Ser. No. 15/277,029, filed Sep. 27, 2016.

REFERENCE TO GOVERNMENT GRANT

This invention was made with government support under CA160344 awarded by the National Institutes of Health. The government has certain rights in the invention.

FIELD OF THE INVENTION

This invention relates generally to microfluidic devices, and in particular, to a device and method to facilitate the prepackaging, handling and use of small volumes of fluids.

BACKGROUND AND SUMMARY OF THE INVENTION

Due to the lower cost, simpler protocols, and less reagent waste, assays are continually transforming towards the smaller scale. Unfortunately, this transformation and the general acceptance of microscale technologies has been slowed due to both technological limitations and the lack of general acceptance by users. More specifically, users are skeptical of new technologies that differ significantly from those to which they are accustomed. Hence, in order to gain acceptance by users, microscale technologies must be reliable and easy to use. Further, the technology must be transitional, so as to constitute an incremental step from current technologies.

To facilitate and to simplify assays and facilitate distribution of microscale technologies, kits have been developed which include all of the reagents and protocols necessary to complete a task. Despite this transition, methods of prepackaging small volumes (e.g., nano- to micro-liter volumes) of reagents remain limited. In addition, even if small volumes of the reagent were prepackaged in a standard tube, recovery of these small volumes of the reagent can be difficult, if not impossible, thereby requiring excess volume of the reagent to be shipped to the user. Thus, it can be appreciated that a technology which enables the prepackaging of small volumes of reagents and enables full recovery of the reagent could bring forth a paradigm shift in the use of microscale technologies.

It is noted that small volume fluid handling capabilities are ubiquitous and required by both industry and academics, spanning multiple disciplines, including: biology, pharmacology, and agriculture, to list a few. The standard tool, used by almost every lab, for measuring and manipulating small volumes of fluids is the pipette. Pipettes have a usable range from approximately 0.2 microliters (μl) to 25 milliliters (ml), with the most accurate low-volume pipettes having a usable range from 0.2 μl to 2 μl. Despite its usable range, these low-volume pipettes carry high levels of imprecision, which increases as the volume decreases. The most prominent sources for this imprecision come from: 1) fluid stuck to the walls (both inside and outside walls) of the pipette; and 2) improper pipetting techniques, both of which are amplified when pipetting high viscosity or low surface energy fluids. This imprecision represents difficulties for many assays which require measurement of small volumes, including:

PCR, staining assays, etc. Thus, a technology that can more precisely measure small volumes of fluid, despite the viscosity or surface energy of the fluid, would enable new assays and provide value.

Therefore, it is a primary object and feature of the present invention to provide a device and method to facilitate the prepackaging, handling and use of small volumes of fluids.

It is a further object and feature of the present invention to provide a device and method to facilitate the prepackaging, handling and use of small volumes of fluids that are amenable to a wide variety of reagents.

It is a still further object and feature of the present invention to provide a device to facilitate the prepackaging, handling and use of small volumes of fluids that is simple to manufacture and easy to use.

In accordance with the present invention, a device is provided to facilitate the handling of a volume of fluid. The device includes an elongated tube having an open first end and a second end. The tube defines a reservoir for receiving the volume of fluid. A stanchion has a first end received within the reservoir of the tube and a second end projecting from the open end of the elongated tube.

The reservoir has a volume less than 10 microliters, and preferably in the range of 0.01 microliters to 6 microliters. The tube has a diameter in the range of 50 micrometers to 1.5 millimeters and a length of 1 millimeter and 15 millimeters. The second end of the tube may be closed, for example, by a seal provided in the second end of the tube. The first end of the stanchion may be fixed to the seal.

In accordance with a further aspect of the present invention, a method is provided for facilitating the handling of volume of fluid. The method includes the step of positioning an elongated tube in a first capsule having the fluid therein. The tube has an open end. The first capsule is centrifuged such that the volume of fluid is received in the tube through the open end.

After the first capsule is centrifuged, the tube is removed from the first capsule. Thereafter, the tube may be positioned in a second capsule free of fluid and having a closed end such that the open end of the tube is spaced from the closed end of the second capsule. The second capsule is centrifuged such that the volume of fluid is expelled from the tube into the second capsule.

It is contemplated for the open end of the tube to be spaced from the closed end of the second capsule by a stanchion. The stanchion extends from the open end of the tube. The tube also includes a second end which is closed, for example, by a seal received within the second end of the tube. The stanchion has a first end fixed within the tube, e.g., to the seal, and a second end positioned outside of the tube.

In accordance with a further aspect of the present invention, a method is provided for facilitating the handling a volume of fluid. The method includes the step of positioning an elongated tube having a reservoir and an open end communicating with the reservoir in a first capsule such that the open end of the tube is spaced from a closed end of the first capsule. The reservoir includes the volume of fluid therein. Thereafter, the first capsule is centrifuged such that the volume of fluid is expelled from the reservoir of the tube into the first capsule.

Prior to positioning the tube in the first capsule, the method may include the additional steps of positioning the tube in a second capsule having the fluid therein; and centrifuging the second capsule such that the volume of the fluid is urged into the tube through the open end. The open end of the tube is spaced from the closed end of the first capsule by a stanchion. The stanchion extends from the open end of the tube. The tube also includes a second end that is closed by, for example, a seal. The stanchion has a first end fixed within the tube, e.g., to the seal, and a second end positioned outside of the tube.

In accordance with a still further aspect of the present invention, a method is provided for facilitating the handling of a volume of fluid. The method includes the step of positioning an elongated tube in a first capsule having fluid therein. The tube has an open end. The first capsule is centrifuged such that the volume of fluid is received in a reservoir in the tube through the open end. The tube is removed from the first capsule and positioned in a second capsule such that the open end of the tube is spaced from a closed end of the second capsule. The second capsule is centrifuged such that the volume of fluid is expelled from the reservoir of the tube.

The tube includes a second end that is closed, e.g., by a seal. The open end of the tube is spaced from the closed end of the second capsule by a stanchion. The stanchion has a first end fixed within the tube, e.g., to the seal, and a second end positioned outside of the tube.

BRIEF DESCRIPTION OF THE DRAWINGS

The drawings furnished herewith illustrate a preferred construction of the present invention in which the above aspects, advantages and features are clearly disclosed as well as others which will be readily understood from the following description of the illustrated embodiments.

In the drawings:

FIG. 4 is a schematic, isometric view of a first and second devices in accordance with the present invention received within into corresponding capsules of a conventional centrifuge;

FIG. 5 is an enlarged, isometric view of a first capsule having the device in accordance with the present invention received therein prior to being centrifuged with the centrifuge of FIG. 4 and prior to being filled with a volume of a fluid;

FIG. 5*a* is an enlarged, schematic view showing a portion of the first capsule of FIG. 5;

FIG. 6 is an enlarged, isometric view of the first capsule having the device in accordance with the present invention received therein after being centrifuged with the centrifuge of FIG. 4 and after being filed with the volume of fluid;

DETAILED DESCRIPTION OF THE DRAWINGS

Figure 1:
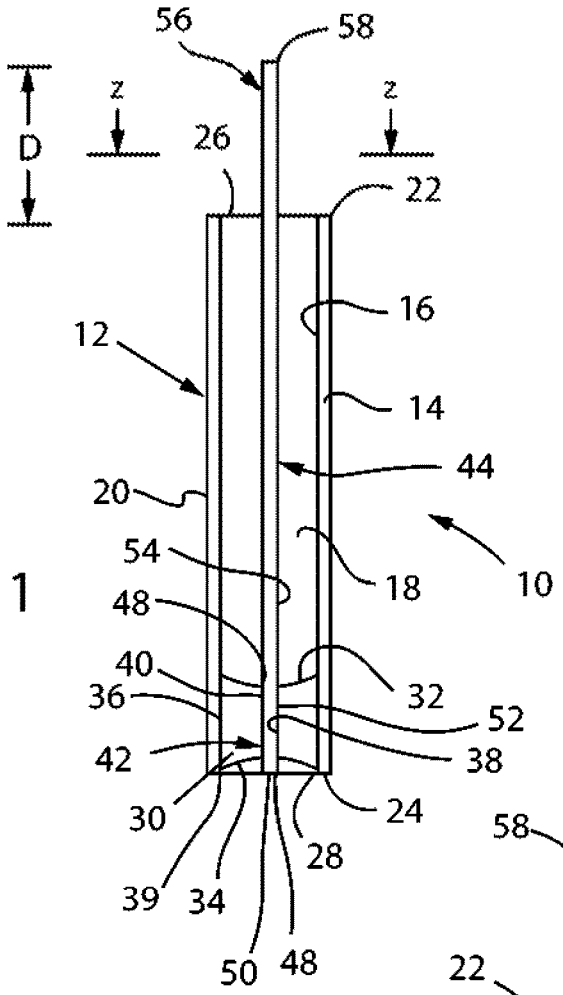
FIG. 1 a schematic, cross-sectional view of a device to facilitate the prepackaging, handling and use of small volumes of fluids in accordance with the present invention.
Figure 2:
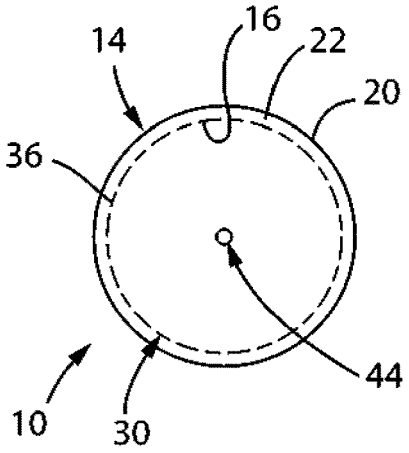
FIG. 2 is a cross-sectional view of the device of the present invention taken along line 2-2 of FIG. 1.

Referring to FIGS. 1-2, a device to facilitate the prepackaging, handling and use of small volumes of fluids in accordance with the present invention is generally designated by the reference numeral 10. Device 10 includes a generally cylindrical tube 12 defined by wall 14. Wall 14 includes a generally cylindrical inner surface 16 defining a reservoir 18 for receiving a volume of fluid therein, as hereinafter described, and a generally cylindrical outer surface 20. While tube 12 is depicted as being cylindrical in the drawing figures, it can be appreciated the other configurations are possible without deviating from the scope of the present invention. By way of example, it is contemplated for tube 12 to have a generally square or rectangular cross-section.

Wall 14 includes a first upper end 22 and a second lower end 24. Upper and lower ends 22 and 24, respectively, define corresponding upper and lower orifices 26 and 28, respectively, which communicate with reservoir 18. Seal 30 is receivable in reservoir 18 of tube 12 through lower orifice 28. Seal 30 extends along a longitudinal axis and includes a generally concave upper surface 32 and a generally concave lower surface 34 interconnected by a generally cylindrical outer surface 36 and a generally cylindrical inner surface 38 radially spaced therefrom. With seal 30 received within reservoir 18 of tube 12, it is intended for outer surface 36 of seal 30 to form a fluidic seal with inner surface 16 of wall 14 so as to prevent fluid received in reservoir 18 from exiting reservoir 18 though orifice 28. In the depicted embodiment, radially outer edge 39 at the intersection of lower surface 34 and outer surface 36 of seal 30 is generally coplanar with lower end 24 of wall 14.

Inner surface 38 of seal 30 includes an upper edge intersecting upper surface 32 of seal 30 so as to define opening 46 and a lower edge intersecting lower surface 34 of seal 30 so as to define opening 48. Inner surface 38 of seal 30 defines a passageway 40 which extends between openings 46 and 48 along the longitudinal axis of seal 30 and which is adapted for receiving a lower end 42 of stanchion 44, as hereinafter described. Openings 46 and 48 are centrally located in upper and lower surfaces 32 and 34, respectively, of seal 30, for reasons hereinafter described.

As previously noted, lower end 42 of stanchion 44 is received within passageway 40 of seal 30 such that lower surface 50 of stanchion 44 is substantially coplanar with lower end 24 of wall 14. It is intended for portion 52 of outer surface 54 of stanchion 44 to engage inner surface 38 of seal 30 so as to form a fluidic seal therewith and prevent fluid received in reservoir 18 from exiting reservoir 18 though passageway 40 in seal 30. With lower end 42 received within passageway 40 of seal 30, stanchion 44 extends axially along the longitudinal axis of seal 30 and through reservoir 18 such that upper end 56 of stanchion 44 is positioned outside of tube 12. More specifically, upper surface 58 of stanchion 44 lies in a plane generally parallel to and spaced from a plane containing upper end 22 of wall 14 by a distance D.

Figure 3:
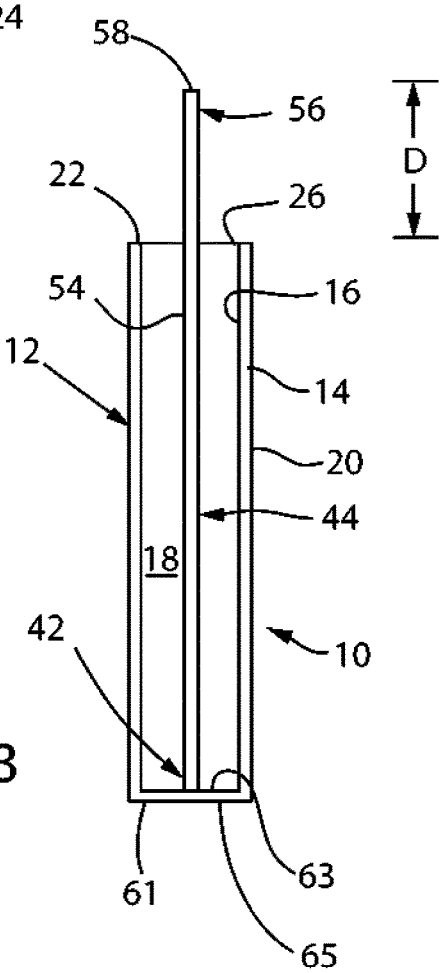
FIG. 3 is a schematic, cross-sectional view of an alternate configuration of a device to facilitate the prepackaging, handling and use of small volumes of fluids in accordance with the present invention.

Referring to FIG. 3, it is contemplated to substitute seal 30 in device 10 with bottom wall 61 which closes lower end 24 of wall 14. More specifically, bottom wall 61 includes a generally flat, upper surface 63 directed towards reservoir 18 and a generally flat, lower surface 65. It is intended for bottom wall 61 to prevent fluid received in reservoir 18 from exiting reservoir 18 therepast. Lower end 42 of stanchion 44 is fixed to the center of upper surface 63 of bottom wall 61 in any suitable manner. Stanchion 44 extends axially along the longitudinally axis of tube 12 and through reservoir 18 such that upper end 56 of stanchion 44 is positioned outside of tube 12. More specifically, upper surface 58 of stanchion 44 lies in a plane generally parallel to and spaced from a plane containing upper end 22 of wall 14 by a distance D.

In operation, in order to fill reservoir 18 of tube 12 with a desired volume of a fluid, such as reagent 59, reagent 59 is provided in capsules of a conventional centrifuge machine 60. Referring to FIG. 4, by way of example, first and second capsules 62 and 64, respectfully, are provided. First and second capsules 62 and 64, respectfully, are identical in structure. As such, the description of first capsule 62 is understood to describe second capsule 64 as if fully described herein. First capsule 62 includes cylindrical body portion 66 having a generally conical or tapered portion 68 depending from the lower end 70 thereof. Tapered portion 68 of first capsule 62 terminates at closed tip 76. It is contemplated for a radially extending flange (not shown) to project from an upper end of cylindrical body portion 66. The flange projecting from the upper end of cylindrical body portion 66 is adapted to mate with lid 70. Lid 70 is attached to cylindrical body portion 66 by lid hinge 72 and is pivotable on lid hinge 72 between an open position allowing access to interior 74 of first capsule 62 and a closed position wherein interior 74 of first capsule 62 is isolated from the external environment.

With lid 70 of first capsule 62 in an open position, device 10 is positioned within interior 74 of first capsule 62 such that lower surface 34 of seal 30 is directed towards closed tip 76 of tapered portion 68 of first capsule 62. In addition, interior 74 of first capsule 62 is filled with a sufficient volume of a desired reagent 59 such that desired reagent 59 overlaps upper orifice 26 defined by wall 14 of tube 12. Thereafter, lid 70 is moved to the closed position and first capsule 62 is deposited in a corresponding retainer 80 in centrifuge machine 60. In a similar manner, a second device 10*a*, identical to device 10, is positioned within interior 74 of second capsule 64 such that lower surface 34 of seal 30 is directed towards closed tip 76 of tapered portion 68 of second capsule 64. In addition, interior 74 of second capsule 64 is filled with a sufficient volume of a desired reagent 59 such that desired reagent 59 in second capsule 64 overlaps upper orifice 26 defined by wall 14 of tube 12 of second device 10*a*. Thereafter, lid 70 is moved to the closed position and second capsule 64 is deposited in a corresponding retainer 80 in centrifuge machine 60.

With first and second capsules 62 and 64, respectively, received in corresponding retainers 80 in centrifuge machine 60, centrifuge machine 60 is actuated so as to centrifuge first and second capsules 62 and 64, respectively, for a desired time period (e.g. 30 seconds) at user selected revolutions per minute. As first and second capsules 62 and 64, respectively, (and hence, first and second devices 10 and 10*a*, respectively) are centrifuged, portions of reagents 59 in first and second capsules 62 and 64, respectively, are urged into corresponding reservoirs 18 in devices 10 and 10*a* such that the air, previously in reservoirs 18, is expelled therefrom, FIG. 5*a*. The volume of fluid received in reservoirs 18 of devices 10 and 10*a* is controlled by the geometry and the volume of reservoirs 18. In the depicted embodiment, reservoirs 18 of devices 10 and 10*a* have a generally cylindrical configuration. However, other configurations are possible without deviating from the scope of the present invention. By way of example, it is contemplated for each reservoir 18 to have a volume less than 10 microliters, and preferably, in the range of 0.01 microliters to 6 microliters. Reservoir 18 may have a diameter in the range of 50 micrometers to 1.5 millimeters and a length in the range of 1 millimeter and 15 millimeters. More specifically, it is contemplated for reservoir 18 to have a diameter of approximately 0.66 mm and a length of approximately 8 mm. However, other diameters and lengths are possible without deviating from the scope of the present invention.

Figure 7:
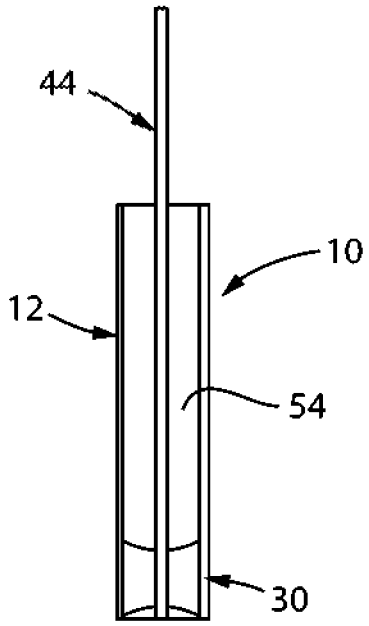
FIG. 7 is a schematic, cross-sectional view of the device in accordance with the present invention after being filed with the volume of fluid.

Referring to FIG. 7, once reservoirs 18 are filled with reagents 59, as heretofore described, devices 10 and 10*a* may be removed from corresponding capsules 62 and 64, respectively. These "prepackaged" devices 10 and 10*a* may be transported to an end user. It is noted that small areas of upper orifices 26 in devices 10 and 10*a* severely limit evaporation, and hence, mitigate the risk of evaporative loss of reagent 59 from reservoirs 18. Further, it is noted that seal 30 receivable in lower orifice 28 of each tube 12 and the small nature of upper orifice 26 prevent loss of reagent 59 from each reservoir 18 in response to an inertial catastrophes, such as the dropping of device 10 and 10*a*.

Figure 8:
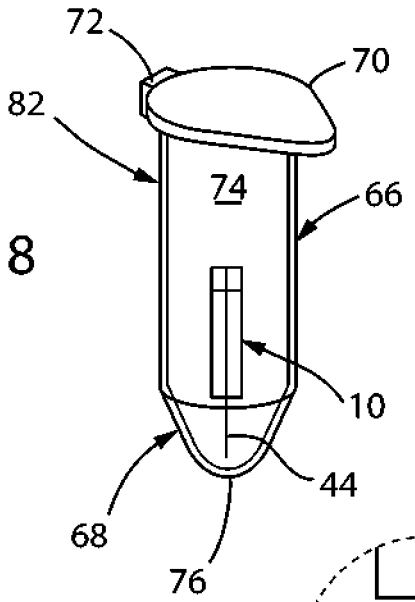
FIG. 8 is an enlarged, isometric view of a second capsule having the device of FIG. 7 received therein prior to being centrifuged with the centrifuge of FIG. 4 and prior to the volume of a fluid being expelled from the device.
Figure 9:
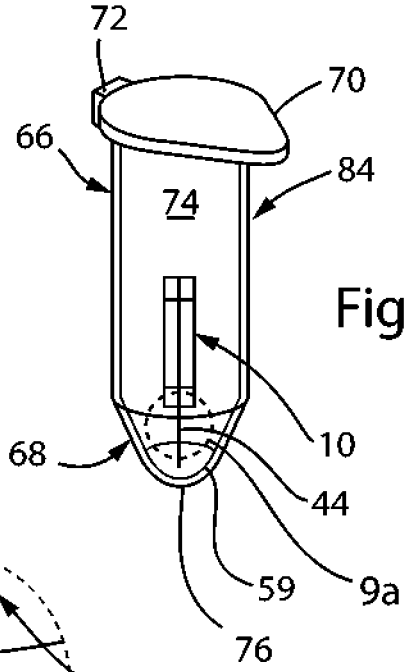
FIG. 9 is an enlarged, isometric view of the second capsule having the device received therein after being centrifuged with the centrifuge of FIG. 4 and after the volume of fluid has been expelled from the device and into the second capsule.
Figure 9A:
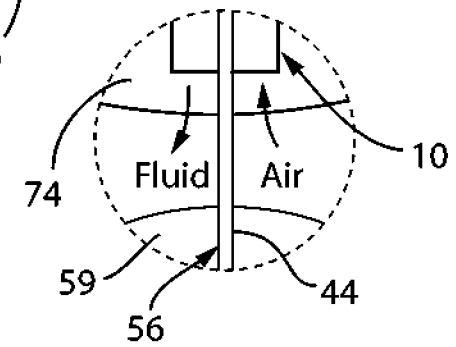
FIG. 9*a* is an enlarged, schematic view showing a portion of the second capsule of FIG. 5.

Referring to FIGS. 8-9*a*, in order to remove the reagents from reservoirs 18 of devices 10 and 10*a*, devices 10 and 10*a* are positioned with corresponding third and fourth capsules 82 and 84, respectively. Third and fourth capsules 82 and 84, respectfully, are identical in structure to first capsule 62. As such, the description of first capsule 62 is understood to describe third and fourth capsules 82 and 84, respectively, as if fully described herein.

Device 10 is positioned within interior 74 of third capsule 62 such that upper end 56 of stanchion 44 is directed towards, and preferably engages, closed tip 76 of tapered portion 68 of third capsule 82. Thereafter, lid 70 is moved to the closed position and third capsule 82 is deposited in a corresponding retainer 80 in centrifuge machine 60. In a similar manner, a second device 10*a*, identical to device 10, is positioned within interior 74 of second capsule 64 such that upper end 56 of stanchion 44 is directed towards, and preferably engages, closed tip 76 of tapered portion 68 of fourth capsule 84. Thereafter, lid 70 is moved to the closed position and fourth capsule 84 is deposited in a corresponding retainer 80 in centrifuge machine 60.

With third and fourth capsules 82 and 84, respectively, received in corresponding retainers 80 in centrifuge machine 60, centrifuge machine 60 is actuated so as to centrifuge third and fourth capsules 82 and 84, respectively, for a desired time period (e.g. 30 seconds) at user selected revolutions per minute. As third and fourth capsules 82 and 84, respectively, (and hence, first and second devices 10 and 10*a*, respectively) are centrifuged, reagents 59 in reservoirs 18 of devices 10 and 10*a* are urged from reservoirs 18 and into corresponding interiors 74 of third and fourth capsules 82 and 84, respectively, FIG. 9*a*. It can be appreciated that during the centrifugation process, stanchion 44 maintains upper orifices 26 of devices 10 and 10*a* in spaced relation to closed tips 76 of tapered portions 68 of third and fourth capsules 82 and 84, respectively, thereby assuring that all of the fluidic contents of reservoirs 18 has been expelled from devices 10 and 10*a* into corresponding interiors 74 of third and fourth capsules 82 and 84, respectively. At this point, the nano- or micro-volumes of reagents 59 have been delivered to interiors 74 of third and fourth capsules 82 and 84, respectively, and are accessible for downstream dilutions or applications.

It is noted that since devices 10 and 10*a* are small, a number of devices 10 and 10*a* can be bundled together in a single capsule, e.g., first capsule 62, so as to allow for the simultaneous filling of multiple devices 10 and 10*a*. Further, it is understood that a number of devices 10 and 10*a* containing different reagents can be bundled together in a single capsule, e.g., third capsule 82, so as to allow for the simultaneous delivery of several different reagents to the interior 74 of such capsule.

Figure 10:
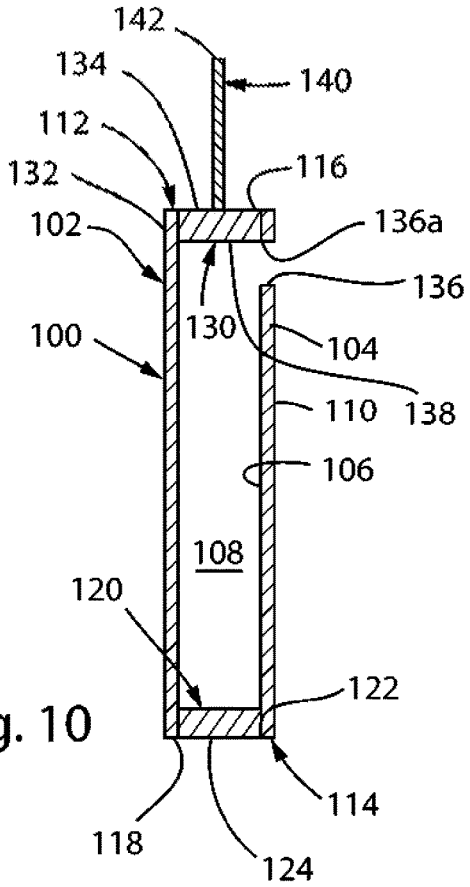
FIG. 10 is a schematic, cross-sectional view of an alternate embodiment of a device to facilitate the prepackaging, handling and use of small volumes of fluids in accordance with the present invention.

Referring to FIG. 10, an alternate embodiment of a device to facilitate the prepackaging, handling and use of small volumes of fluids in accordance with the present invention is generally designated by the reference numeral 100. Device 100 includes a generally cylindrical tube 102 defined by wall 104. Wall 104 includes a generally cylindrical inner surface 106 defining a reservoir 108 for receiving a volume of fluid therein, as hereinafter described, and a generally cylindrical outer surface 110. While tube 102 is depicted as being cylindrical in the drawing figures, it can be appreciated the other configurations are possible without deviating from the scope of the present invention. By way of example, it is contemplated for tube 102 to have a generally square or rectangular cross-section.

Wall 104 includes a first upper end 112 and a second lower end 114. Upper and lower ends 112 and 114, respectively, define corresponding upper and lower orifices 116 and 118, respectively, which communicate with reservoir 108. Seal 120 is receivable in reservoir 108 of tube 102 through lower orifice 118. Seal 120 extends along a longitudinal axis and includes a generally cylindrical outer surface 122. It is intended for outer surface 122 of seal 120 to form a fluidic seal with inner surface 106 of wall 104 so as to prevent fluid received in reservoir 108 from exiting reservoir 108 though lower orifice 118. In the depicted embodiment, lower surface 124 of seal 120 is generally coplanar with lower end 114 of wall 104.

Seal 130 is receivable in reservoir 108 of tube 102 through upper orifice 116. Seal 130 extends along a longitudinal axis and includes a generally cylindrical outer surface 132. It is intended for outer surface 132 of seal 130 to form a fluidic seal with inner surface 106 of wall 104 so as to prevent fluid received in reservoir 108 from exiting reservoir 108 though upper orifice 116. In the depicted embodiment, upper surface 134 of seal 130 is generally coplanar with upper end 112 of wall 104. It is contemplated to provide opening 136 through wall 104 at a location spaced from the intersection of outer surface 132 of seal 130 and inner surface 106 of wall 104 such that opening 136 communicates with reservoir 108. Upper portion 136*a* of opening 136 is generally coplanar with lower surface 138 of seal 130 to facilitate the flow of fluid into and out of reservoir 108, as hereinafter described.

Stanchion 140 projects from upper surface 134 of seal 130, for example, along the longitudinal axis of seal 130. However, stanchion 140 may project from other locations of or along other angles to upper surface 134 of seal 130. It is contemplated for upper surface 142 of stanchion 140 to lie in a plane generally parallel to and spaced from a plane containing upper end 112 of wall 104.

In order to fill device 100, device 100 is positioned within interior 74 of a capsule, e.g, first capsule 62, such that upper surface 142 of stanchion 140 is directed away from closed tip 76 of tapered portion 68 of first capsule 62. In addition, interior 74 of first capsule 62 is filled with a sufficient volume of a desired reagent 59 such that desired reagent 59 overlaps opening 136 in wall 104 of tube 102. Thereafter, lid 70 is moved to the closed position and first capsule 62 is deposited in a corresponding retainer 80 in centrifuge machine 60. With first capsule 62 received in a corresponding retainer 80 in centrifuge machine 60, centrifuge machine 60 is actuated so as to centrifuge first capsule 62 for a desired time period (e.g. 30 seconds) at user selected revolutions per minute. As first capsule 62 (and hence, device 100) is centrifuged, a portion of reagent 59 in first capsule 62 is urged into corresponding reservoir 108 in device 100 such that the air, previously in reservoir 108, is expelled therefrom. The volume of fluid received in reservoir 108 of device 100 is controlled by the geometry and the volume of reservoir 108. By way of example, it is contemplated for each reservoir 108 to have a volume less than 10 microliters, and preferably, in the range of 0.01 microliters to 6 microliters, Reservoir 18 may have a diameter in the range of 50 micrometers to 1.5 millimeters and a length in the range of 1 millimeter and 15 millimeters. More specifically, it is contemplated for reservoir 108 to have a diameter of approximately 0.66 mm and a length of approximately 8 mm. However, other diameters and lengths are possible without deviating from the scope of the present invention. Once reservoir 108 is filled with reagent 59, as heretofore described, device 100 may be removed from capsule 62. This "prepackaged" device 100 may be transported to an end user. It is noted that small area of opening 136 in device 100 severely limits evaporation, and hence, mitigates the risk of evaporative loss of reagent 59 from reservoir 108.

In order to remove the reagent 59 from reservoir 108 of device 100, device 100 is positioned within a corresponding capsule, e.g. third capsule 82, such that upper surface 142 of stanchion 140 is directed towards, and preferably engages, closed tip 76 of tapered portion 68 of third capsule 82. Thereafter, lid 70 is moved to the closed position and third capsule 82 is deposited in a corresponding retainer 80 in centrifuge machine 60. With third capsule 82 received in retainer 80 in centrifuge machine 60, centrifuge machine 60 is actuated so as to centrifuge third capsule 82 for a desired time period (e.g. 30 seconds) at user selected revolutions per minute. As third capsule 82 (and hence, device 100) is centrifuged, reagent 59 in reservoir 108 of device 100 is urged from reservoir 108 through opening 136 and into corresponding interior 74 of third capsule 82. It can be appreciated that during the centrifugation process, stanchion 140 maintains opening 136 in device 100 in spaced relation to closed tip 76 of tapered portion 68 of third capsule 82 thereby assuring that all of the fluidic contents of reservoir 108 has been expelled from device 100 into corresponding interior 74 of third capsule 82, respectively. As this point, the nano- or micro-volumes of reagent 59 has been delivered to interior 74 of third capsule 82 and is accessible for downstream dilutions or applications.

Figure 11:
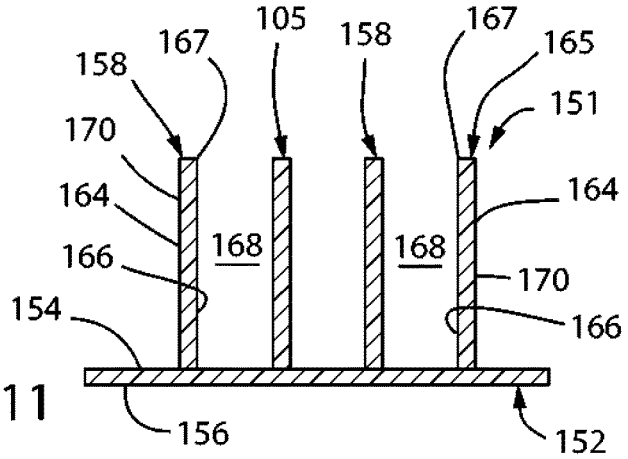
FIG. 11 is a schematic, cross-sectional view of a still further embodiment of a device to facilitate the prepackaging, handling and use of small volumes of fluids in accordance with the present invention received within into a corresponding capsule of a conventional centrifuge prior to being filled with a volume of a fluid.
Figure 12:
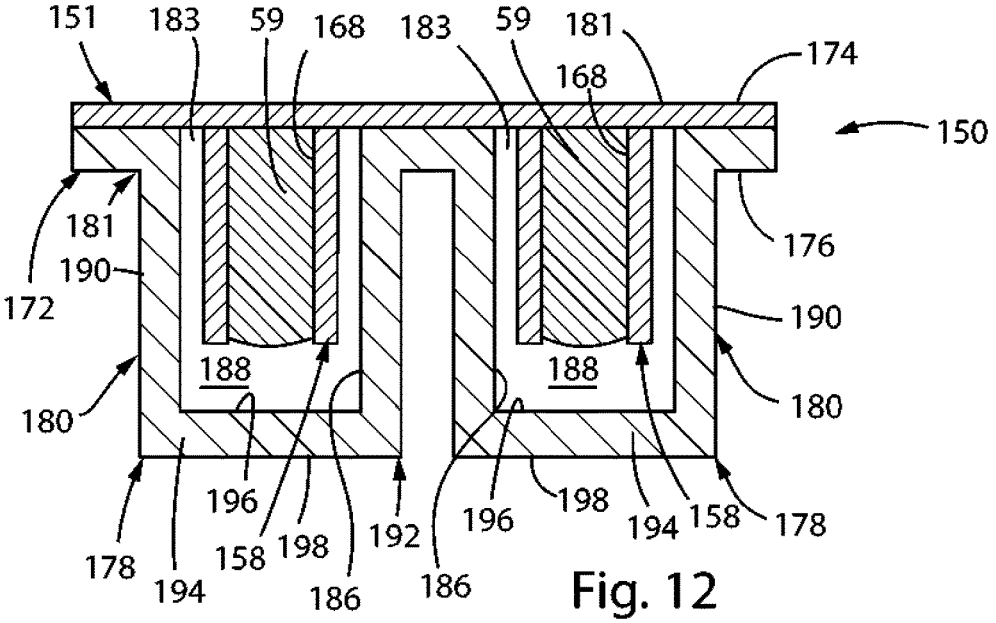
FIG. 12 is a schematic, cross-sectional view of the device of FIG. 11 received within into a corresponding capsule of a conventional centrifuge prior to the volume of a fluid being expelled from the device.

Referring to FIGS. 11 and 12, a still further embodiment of a device to facilitate the prepackaging, handling and use of small volumes of fluids in accordance with the present invention is generally designated by the reference number 150. Device 150 includes lid 151, FIG. 11, having a generally planar plate 152 with first and second opposite sides 154 and 156, respectively. A plurality of cylindrical tubes 158 project from first side 154 of plate 152. By way of example, in the depicted embodiment, a pair of spaced cylindrical tubes 158 project from first side 154 of plate 152. However, additional cylindrical tubes 158 may project from first side 154 of plate 152 without deviating from the scope of the present invention. Each cylindrical tube 158 extends along a corresponding axis and is defined by wall 164 terminating at terminal edge 165. Terminal edges 165 of walls 164 define openings 167 in cylindrical tubes 158. Each wall 164 further includes a generally cylindrical inner surface 166 defining a reservoir 168 for receiving a volume of fluid therein, as hereinafter described, and a generally cylindrical outer surface 170. While each tube 158 is depicted as being cylindrical in the drawing figures, it can be appreciated the other configurations are possible without deviating from the scope of the present invention. By way of example, it is contemplated for tube 158 to have a generally square or rectangular cross-section.

Device 150 further includes generally planar base 172 with first and second opposite sides 174 and 176, respectively, FIG. 12. A plurality of cylindrical recesses 178 are formed in first side 174 of base 172 and project from second side 176 of base 172. By way of example, the number of spaced cylindrical recess 178 in base 172 is equal to the number of cylindrical tubes 158 projecting from first side 154 of plate 152 of lid 151. However, additional cylindrical recess 178 may be formed in base 172 without deviating from the scope of the present invention. Each cylindrical recess 178 extends along a corresponding axis and is defined by wall 180. Wall 180 includes a generally cylindrical inner surface 186 defining a reservoir 188 for receiving a volume of fluid therein, as hereinafter described, and a generally cylindrical outer surface 190. While each recess 178 is depicted as being cylindrical in the drawing figures, it can be appreciated the other configurations are possible without deviating from the scope of the present invention. By way of example, it is contemplated for recess 178 to have a generally square or rectangular cross-section. First end 181 of each wall 180 intersects base 172 and defines a corresponding opening 183 in base 172 which communicates with reservoir 188 in a corresponding cylindrical recess 178. Each opening 183 in base 172 is of sufficient dimension to allow a corresponding cylindrical tube 158 of lid 151 to pass therethrough into reservoir 188 of a corresponding cylindrical recess 178 in base 172. Second end 192 of each wall 180 intersects a corresponding end wall 194 having an inner surface 196 partially defining reservoir 188.

In order to fill lid 151 of device 150, device 150 is positioned within interior 74 of a capsule, e.g, first capsule 62, such that openings 167 in cylindrical tubes 158 are directed away from closed tip 76 of tapered portion 68 of first capsule 62. In addition, interior 74 of first capsule 62 is filled with a sufficient volume of a desired reagent 59 such that desired reagent 59 overlaps openings 167. Thereafter, lid 70 is moved to the closed position and first capsule 62 is deposited in a corresponding retainer 80 in centrifuge machine 60. With first capsule 62 received in a corresponding retainer 80 in centrifuge machine 60, centrifuge machine 60 is actuated so as to centrifuge first capsule 62 for a desired time period (e.g. 30 seconds) at user selected revolutions per minute. As first capsule 62 (and hence, device 100) is centrifuged, a portion of reagent 59 in first capsule 62 is urged into corresponding reservoirs 168 in cylindrical tubes 158 through openings 167 such that the air, previously in reservoirs 168, is expelled therefrom. The volumes of fluid received in reservoirs 168 of cylindrical tubes 158 are controlled by the geometry and the volume of reservoirs 168. By way of example, it is contemplated for each reservoir 168 to have a volume less than 10 microliters, and preferably, in the range of 0.01 microliters to 6 microliters. Reservoir 168 may have a diameter in the range of 50 micrometers to 1.5 millimeters and a length in the range of 1 millimeter and 15 millimeters. More specifically, it is contemplated for reservoir 168 to have a diameter of approximately 0.66 mm and a length of approximately 8 mm. However, other diameters and lengths are possible without deviating from the scope of the present invention.

Once reservoir 168 is filled with reagent 59, as heretofore described, lid 151 of device 150 may be removed from capsule 62 and interconnected to base 172 so as to form device 150. More specifically, to form device 150, lid 151 is inserted into base 172 such that cylindrical tubes 158 of lid 151 are received in corresponding cylindrical recesses 178 in base 172. As such, the "prepackaged" device 150 may be transported to an end user. It is noted that lid 151 interconnected to base 172, openings 167 in cylindrical tubes 178 of lid 151 are spaced from corresponding inner surfaces 196 of end walls 194 partially defining reservoirs 188 of base 172.

In order to remove the reagent 59 from reservoirs 168 of lid 151, device 150, namely, the lid 151 and base 172 combination is centrifuged. By way of example, lid 151 and base 172 combination may be positioned within a corresponding capsule, e.g. third capsule 82 such that outer surfaces 198 of end walls 194 of base 172 are directed towards closed tip 76 of tapered portion 68 of third capsule 82. However, it can be appreciated that other arrangements for centrifuging lid 151 and base 172 combination are contemplated as being within the scope of the present invention. Thereafter, once lid 151 and base 172 combination is positioned within a corresponding capsule, e.g. third capsule 82, lid 70 is moved to the closed position and third capsule 82 is deposited in a corresponding retainer 80 in centrifuge machine 60. With third capsule 82 received in retainer 80 in centrifuge machine 60, centrifuge machine 60 is actuated so as to centrifuge third capsule 82 for a desired time period (e.g. 30 seconds) at user selected revolutions per minute. As third capsule 82 (and hence, device 100) is centrifuged, reagents 59 in reservoirs 168 of lid 151 are urged from reservoir 168 and into corresponding reservoirs 188 in cylindrical recesses 178 of base 172. It can be appreciated that during the centrifugation process, the spacing between openings 167 in cylindrical tubes 178 of lid 151 and the corresponding inner surfaces 196 of end walls 194 partially defining reservoirs 188 of base 172 allows for all of the fluidic contents of reservoirs 168 to be expelled therefrom into corresponding reservoirs 188 in cylindrical recesses 178 abase 172. After removal of lid 151 from base 172, the nano- or micro-volumes of reagents 59 in reservoirs 188 in cylindrical recesses 178 of base 172 are accessible for downstream dilutions or applications.

It can be appreciated that the above descriptions of devices are merely exemplary of the present invention. Various modes of carrying out the invention are contemplated as being within the scope of the following claims particularly pointing out and distinctly claiming the subject matter, which is regarded as the invention.

We claim:

1. A method for facilitating the handling of a volume of fluid, comprising the steps:

positioning an elongated tube in a first capsule having the fluid therein, the tube having an opening adjacent an end of the tube and an inner surface defining a reservoir communicating with the opening;

operatively connecting a stanchion to the tube, the stanchion projecting away from the end of the tube and terminating at a terminal end which is maintained outside of the reservoir and is spaced from the end of the tube; and centrifuging the first capsule such that the volume of fluid is received in the reservoir of the tube through the opening.

2. The method of claim 1 comprising the additional step of removing the tube from the first capsule.

3. The method of claim 1 further comprising the additional step of positioning the tube in a second capsule free of fluid and having a closed end such that the opening of the tube is spaced from the closed end of the second capsule.

4. The method of claim 3 comprising the additional step of centrifuging the second capsule such that the volume of fluid is expelled from the reservoir of the tube into the second capsule.

5. The method of claim 3 including the additional step of spacing the opening of the tube from the closed end of the second capsule by the stanchion.

6. The method of claim 2 wherein the end of the tube is a first end and the tube includes a second closed end.

7. The method of claim 6 wherein the stanchion further includes a fixed end fixed within the reservoir of the tube.

8. The method of claim 6 further comprising a seal received within the tube and closing the second end of the tube.

9. A method for facilitating the handling of a volume of fluid, comprising the steps:

operatively connecting a stanchion to an elongated tube having a reservoir and an opening adjacent an end thereof, the stanchion projecting away from the end of the tube and terminating at a terminal end which is maintained outside of the reservoir and is spaced from the end of the tube;

positioning the tube in a first capsule such that that the opening of the tube is spaced from a closed end of the first capsule by the stanchion, the reservoir including the volume of fluid therein; and centrifuging the first capsule such that the volume of fluid is expelled from the reservoir through the opening of the tube.

10. The method of claim 9 comprising the additional steps prior to positioning the tube in the first capsule:

positioning the tube in a second capsule having the fluid therein; and centrifuging the second capsule such that the volume of the fluid is urged into the reservoir of tube through the opening.

11. The method of claim 9 wherein end of the tube is a first end and the tube includes a second closed end.

12. The method of claim 11 further comprising a seal received within the tube and closing the second end of the tube.

13. The method of claim 9 wherein the stanchion has a fixed end fixed within the tube.

14. A method for facilitating the handling of a volume of fluid, comprising the steps:

operatively connecting a stanchion to an elongated tube having a reservoir and an opening at an end thereof, the stanchion projecting away from the end of the tube and terminating at a terminal end which is maintained outside of the reservoir and is spaced from the end of the tube;

positioning the elongated tube in a first capsule having fluid therein;

centrifuging the first capsule such that the volume of fluid is received in a reservoir in the tube through the opening;

removing the tube from the first capsule;

positioning the tube in a second capsule such that the opening of the tube is spaced from a closed end of the second capsule by the stanchion; and centrifuging the second capsule such that the volume of fluid is expelled from the reservoir of the tube through the opening.

15. The method of claim 14 wherein the end of the tube is a first end and the tube includes a second closed end.

16. The method of claim 14 wherein the stanchion has a fixed end fixed within the tube.

17. The method of claim 14 wherein the end of the tube is a first end and the tube has a second end and wherein the method further comprises inserting a seal into the second end of tube to prevent the flow of fluid from the reservoir through the second end of the tube.

* * * * *